US010969146B2

(12) United States Patent
Moore et al.

(10) Patent No.: US 10,969,146 B2
(45) Date of Patent: Apr. 6, 2021

(54) REFRIGERANT DISTRIBUTOR FOR FALLING FILM EVAPORATOR

(71) Applicant: Carrier Corporation, Palm Beach Gardens, FL (US)

(72) Inventors: Bryce Kirk Moore, Syracuse, NY (US); XingHua Huang, Shanghai (CN)

(73) Assignee: CARRIER CORPORATION, Palm Beach Gardens, FL (US)

( * ) Notice: Subject to any disclaimer, the term of this patent is extended or adjusted under 35 U.S.C. 154(b) by 79 days.

(21) Appl. No.: 16/328,477

(22) PCT Filed: Aug. 25, 2017

(86) PCT No.: PCT/US2017/048566

§ 371 (c)(1),
(2) Date: Feb. 26, 2019

(87) PCT Pub. No.: WO2018/039532

PCT Pub. Date: Mar. 1, 2018

(65) Prior Publication Data

US 2019/0195541 A1 Jun. 27, 2019

Related U.S. Application Data

(60) Provisional application No. 62/380,159, filed on Aug. 26, 2016.

(51) Int. Cl.
*F25B 39/02* (2006.01)
*F28F 9/02* (2006.01)
(Continued)

(52) U.S. Cl.
CPC ..... *F25B 39/028* (2013.01); *F25B 39/02* (2013.01); *F28D 7/16* (2013.01); *F28D 21/0017* (2013.01);
(Continued)

(58) Field of Classification Search
CPC ..... F25B 2339/0242; F25B 39/02; F25B 39/028; F28D 2021/0071; F28D 21/0017; F28D 7/16; F28F 9/0263
(Continued)

(56) References Cited

U.S. PATENT DOCUMENTS 472,671 A 4/1892 Jacobs
1,636,958 A 7/1927 Harter
(Continued)

FOREIGN PATENT DOCUMENTS

CN 1139769 A 1/1997
CN 103673694 A 3/2014
(Continued)

OTHER PUBLICATIONS

International Search Report for International Application No. PCT/US2017/048566; International Filing Date Aug. 25, 2017; dated Nov. 9, 2017; 6 Pages.
(Continued)

*Primary Examiner* — Henry T Crenshaw
(74) *Attorney, Agent, or Firm* — Cantor Colburn LLP

(57) ABSTRACT

A falling film evaporator (12) includes an evaporator vessel (26), a plurality of evaporator tubes (38) disposed in the in evaporator vessel (26) through which a volume of thermal energy transfer medium is flowed and a suction port (42) extending through the evaporator vessel (26) to remove vapor refrigerant from the evaporator vessel (26). A refrigerant distribution system (34) is located in the evaporator vessel (26) to distribute a flow of liquid refrigerant over the plurality of evaporator tubes (38). The refrigerant distribution system (34) is configured such that the refrigerant distribution system (34) has a first height at the suction port (42) and a second height greater than the first height at a longitudinal location (28) other than at the suction port (42).

14 Claims, 4 Drawing Sheets

(51) Int. Cl.
*F28D 7/16* (2006.01)
*F28D 21/00* (2006.01)

(52) U.S. Cl.
CPC .... *F28F 9/0263* (2013.01); *F25B 2339/0242* (2013.01); *F28D 2021/0071* (2013.01)

(58) Field of Classification Search
USPC ..... 62/525
See application file for complete search history.

(56) References Cited

U.S. PATENT DOCUMENTS

| | | | | |
|---|---|---|---|---|
| 1,979,751 | A | 11/1934 | Leach | |
| 2,341,319 | A | 2/1944 | Graham et al. | |
| 4,858,681 | A | 8/1989 | Sulzberger | |
| 5,373,709 | A | 12/1994 | Tongu et al. | |
| 5,546,761 | A * | 8/1996 | Matsuo | F25B 39/04 165/173 |
| 5,645,124 | A * | 7/1997 | Hartfield | B01D 1/04 165/117 |
| 5,704,422 | A | 1/1998 | Chess et al. | |
| 6,167,713 | B1 | 1/2001 | Hartfield et al. | |
| 6,868,695 | B1 | 3/2005 | Dingel et al. | |
| 8,833,437 | B2 | 9/2014 | Singh et al. | |
| 8,944,152 | B2 | 2/2015 | Kulankara et al. | |
| 2011/0056664 | A1 | 3/2011 | De Larminat et al. | |
| 2015/0013951 | A1 | 1/2015 | Numata et al. | |

FOREIGN PATENT DOCUMENTS

| | | | |
|---|---|---|---|
| CN | 105157455 | A | 12/2015 |
| KR | 100331985 | B1 | 4/2002 |
| WO | 2015034573 | A1 | 3/2015 |
| WO | 2016077436 | A1 | 5/2016 |

OTHER PUBLICATIONS

Written Opinion for International Application No. PCT/US2017/048566; International Filing Date Aug. 25, 2017; dated Nov. 9, 2017; 7 Pages.

* cited by examiner

REFRIGERANT DISTRIBUTOR FOR FALLING FILM EVAPORATOR

CROSS REFERENCE TO RELATED APPLICATIONS

This application is a National Stage application of PCT/US2017/048566, filed Aug. 25, 2017, which claims the benefit of U.S. Provisional Application No. 62/380,159, filed Aug. 26, 2016, both of which are incorporated by reference in their entirety herein.

BACKGROUND

The subject matter disclosed herein relates to heating, ventilation and air conditioning (HVAC) systems. More specifically, the subject matter disclosed herein relates to falling film evaporators for HVAC systems.

HVAC systems, such as chillers, use an evaporator to facilitate a thermal energy exchange between a refrigerant in the evaporator and a medium flowing in a number of evaporator tubes positioned in the evaporator. In a flooded evaporator, the tubes are submerged in a pool of refrigerant. This results in a particularly high volume of refrigerant necessary, depending on a quantity and size of evaporator tubes, for efficient system operation. Another type of evaporator used in chiller systems is a falling film evaporator. In a falling film evaporator, the evaporator tubes are positioned typically below a distribution manifold from which refrigerant is urged, forming a "falling film" on the evaporator tubes, utilizing gravity to drive the flow of refrigerant over the evaporator tubes. Evaporation is primarily accomplished through thin film evaporation on the surface of the evaporator tubes, while a small fraction of refrigerant is boiled off in a pool boiling section of the evaporator.

As regulatory & industry trends continues to drive towards replacement of conventional HFC's like R134a, of particular interest are the class of "low pressure refrigerants", i.e. refrigerants that are near or below atmospheric pressure at typical boiling temperatures in a chiller. These refrigerants can provide environmental benefits through increased cycle efficiencies, reduced global warming potential, and slower refrigerant leak rates. However, in real systems their lower vapor densities can result in a refrigerant pressure drops that can offset any performance gains.

Low pressure refrigerants offer potential for high efficiency refrigeration systems, but are very sensitive to changes in pressure, meaning that pressure losses greatly increase energy use. For this reason, velocities and flow resistances must be minimized by enlarging HX vessels and refrigerant lines. However, enlarged vessel and line sizes increase cost and physical footprint of these chiller systems, so solutions that can optimize vessel size and pressure drop are critical.

BRIEF SUMMARY

In one embodiment, a falling film evaporator includes an evaporator vessel, a plurality of evaporator tubes disposed in the evaporator vessel through which a volume of thermal energy transfer medium is flowed and a suction port extending through the evaporator vessel to remove vapor refrigerant from the evaporator vessel. A refrigerant distribution system is located in the evaporator vessel to distribute a flow of liquid refrigerant over the plurality of evaporator tubes. The refrigerant distribution system is configured such that the refrigerant distribution system has a first height at the suction port and a second height greater than the first height at a longitudinal location other than at the suction port.

Additionally or alternatively, in this or other embodiments the first height is a minimum height of the refrigerant distribution system.

Additionally or alternatively, in this or other embodiments the first height transitions to the second height with a linear slope.

Additionally or alternatively, in this or other embodiments the first height transitions to the second height via a vertical step.

Additionally or alternatively, in this or other embodiments the suction port is located at a first longitudinal end of the evaporator vessel.

Additionally or alternatively, in this or other embodiments the second height is located at a second longitudinal end of the evaporator vessel opposite the first longitudinal end.

Additionally or alternatively, in this or other embodiments the suction port is located between a first longitudinal end of the evaporator vessel and a second longitudinal end of the evaporator vessel and the first height is a minimum vapor-liquid separator height.

Additionally or alternatively, in this or other embodiments the second height is at one or more of the first longitudinal end or the second longitudinal end and is a maximum height of the refrigerant distribution system.

Additionally or alternatively, in this or other embodiments the refrigerant distribution system includes a distributor located in the evaporator vessel above the plurality of evaporator tubes to distribute a flow of liquid refrigerant over the plurality of evaporator tubes, and a vapor-liquid separator located in the evaporator vessel to separate the vapor refrigerant from a vapor and liquid refrigerant mixture. The vapor-liquid separator is configured such that the vapor-liquid separator has a first height at the suction port and a second height greater than the first height at a longitudinal location other than at the suction port.

In another embodiment, a heating, ventilation and air conditioning (HVAC) system includes a condenser flowing a flow of refrigerant therethrough and a falling film evaporator in flow communication with the condenser. The falling film evaporator includes an evaporator vessel and a plurality of evaporator tubes located in the evaporator vessel through which a volume of thermal energy transfer medium is flowed. A distributor is located in the evaporator vessel above the plurality of evaporator tubes to distribute a flow of liquid refrigerant over the plurality of evaporator tubes. A suction port extends through the evaporator vessel to remove vapor refrigerant from the evaporator vessel, and a vapor-liquid separator is located in the evaporator vessel to separate the vapor refrigerant from a vapor and liquid refrigerant mixture. The vapor-liquid separator is configured such that the vapor-liquid separator has a first height at the suction port and a second height greater than the first height at a longitudinal location other than at the suction port.

Additionally or alternatively, in this or other embodiments the first height is a minimum height of the vapor-liquid separator.

Additionally or alternatively, in this or other embodiments the first height transitions to the second height with one of a linear slope or a vertical step.

Additionally or alternatively, in this or other embodiments the suction port is located between a first longitudinal end of the evaporator vessel and a second longitudinal end of the evaporator vessel and the first height is a minimum vapor-liquid separator height.

Additionally or alternatively, in this or other embodiments the second height is at one or more of the first longitudinal end or the second longitudinal end.

Additionally or alternatively, in this or other embodiments the second height is a maximum height of the vapor-liquid separator.

BRIEF DESCRIPTION OF THE DRAWINGS

The subject matter is particularly pointed out and distinctly claimed at the conclusion of the specification. The foregoing and other features, and advantages of the present disclosure are apparent from the following detailed description taken in conjunction with the accompanying drawings in which:

DETAILED DESCRIPTION

Figure 1:
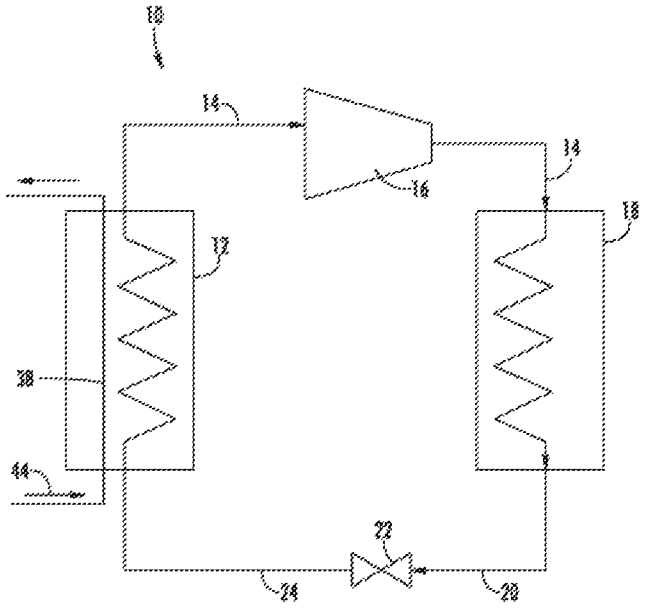
FIG. 1 is a schematic view of an embodiment of a heating, ventilation and air conditioning system.

Shown in FIG. 1 is a schematic view an embodiment of a heating, ventilation and air conditioning (HVAC) unit, for example, a chiller 10 utilizing a falling film evaporator 12. A flow of vapor refrigerant 14 is directed into a compressor 16 and then to a condenser 18 that outputs a flow of liquid refrigerant 20 to an expansion valve 22. The expansion valve 22 outputs a vapor and liquid refrigerant mixture 24 toward the evaporator 12. The evaporator 12 includes a plurality of evaporator tubes 38 located therein, through which a heat transfer fluid 44 is circulated. The heat transfer fluid 44 is cooled via thermal energy transfer with the flow of refrigerant at the evaporator 12.

Figure 2:
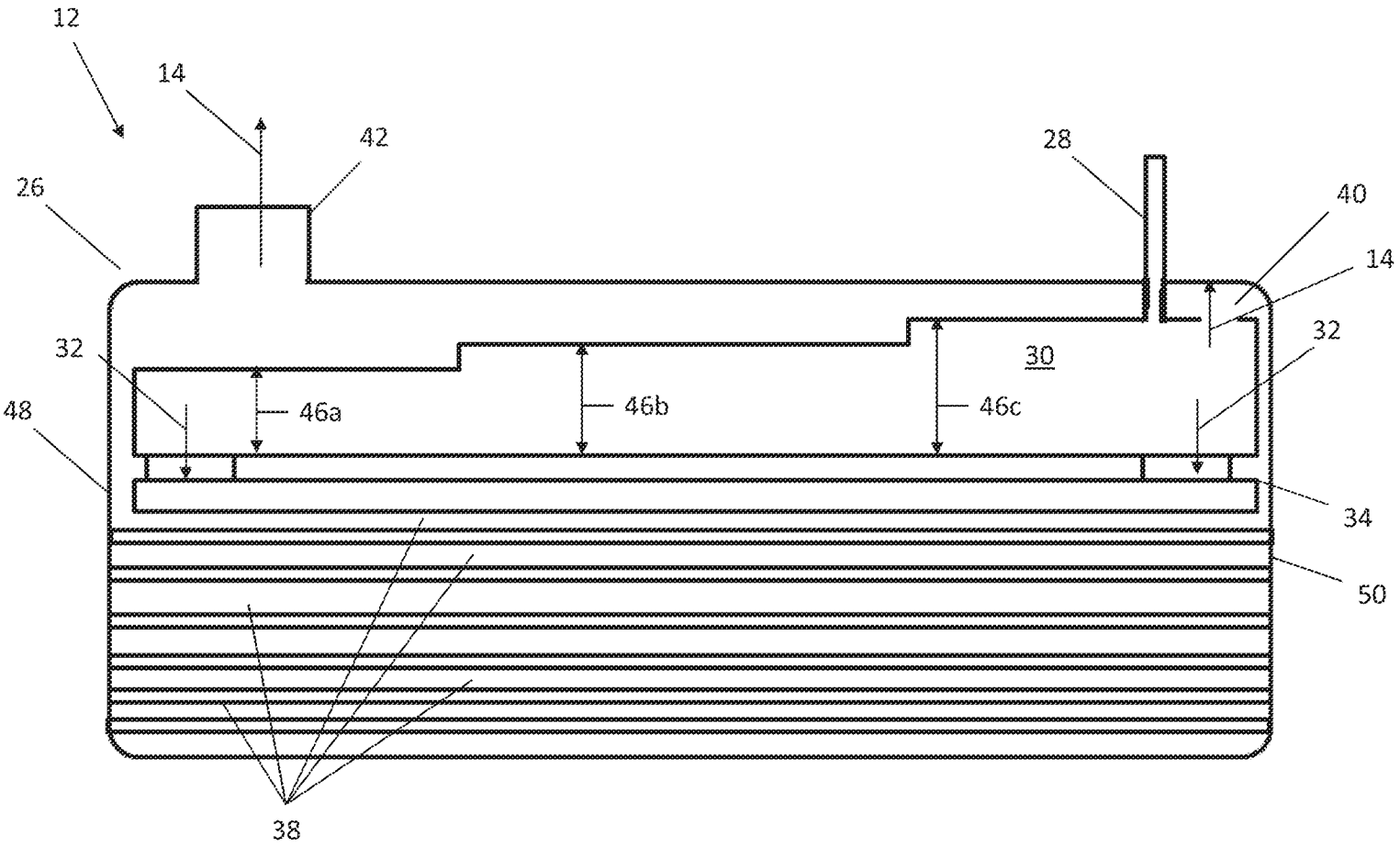
FIG. 2 is a schematic view of an embodiment of a falling film evaporator for an HVAC system.

Referring now to FIG. 2, as stated above, the evaporator 12 is a falling film evaporator. The evaporator 12 includes an evaporator vessel 26 in which a refrigerant distribution system of the evaporator 12 is located. In some embodiments, the distribution system includes a distributor 34 and/or a vapor liquid separator 30, as well as other components. An inlet port 28 extends through the evaporator vessel 26 to admit the vapor and liquid refrigerant mixture 24 into the evaporator 12. The vapor and liquid refrigerant mixture 24 is directed from the inlet port 28 into the vapor-liquid separator 30 in which liquid refrigerant 32 is separated from the vapor and liquid refrigerant mixture 24. The liquid refrigerant 32 is flowed from the vapor-liquid separator 30 into the distributor 34, while vapor refrigerant 14 exits the vapor-liquid separator 30 through a vapor vent 40 and flows toward a suction port 42 extending through the evaporator vessel 26 which directs the vapor refrigerant 14 toward the compressor 16. While in the embodiment of FIG. 2, the vapor-liquid separator 30 is located inside the evaporator vessel 26, it is to be appreciated that in other embodiments the vapor-liquid separator 30 may be located outside of the evaporator vessel 26.

The distributor 34 is located above the evaporator tubes 38 to distribute the liquid refrigerant 32 over the evaporator tubes 38 via one or more distributor ports (not shown). A thermal energy exchange occurs between a flow of heat transfer medium 44 (shown in FIG. 1) flowing through the evaporator tubes 38 into and out of the evaporator 12 and the liquid refrigerant 32. As the liquid refrigerant 32 is boiled off in the evaporator 12, the resulting vapor refrigerant 14 is directed to the compressor 16 via the suction port 42. While the evaporator 12 shown is rectangular in cross-section, one skilled in the art will appreciate that the evaporator 12 may be a variety of shapes, including spherical, cylindrical, rectilinear or any combination of shapes such as these.

The highest vapor velocities in an evaporator 12 occur near the suction port 42 where the vapor refrigerant 14 exits the evaporator vessel 26. The relatively high velocities in this region make it especially prone to pressure and efficiency loss. This is especially challenging in a falling film evaporator, in which refrigerant distribution systems occupy space near the top of the heat exchanger and relatively close to the suction port 42.

To optimize the efficiency, cost, and physical space of the evaporator 12, the height of the refrigerant distribution system, in some embodiments the vapor-liquid separator 30 is varied along the length of the evaporator vessel 26. In the vicinity of the suction port 42, a vapor-liquid separator height 46 is reduced, providing an increased space between the vapor-liquid separator 30 and the suction port 42 for vapor refrigerant flow. Conversely, the vapor-liquid separator height 46 is increased at locations further from the suction port 42 area where vapor refrigerant flow velocities are lower and efficiency impacts are less critical. The larger cross section of the vapor-liquid separator 30 in the regions further from the suction port 42 improves vapor-liquid separation and refrigerant distribution functionality than would be possible with a smaller evaporator 12. The net effect of the configuration is that the evaporator 12 can have a more compact diameter and lower cost for a given efficiency and cooling capacity. While in the embodiment of FIG. 2, the height of the vapor-liquid separator 30 is varied, it is to be appreciated that in other arrangements such as when the vapor-liquid separator 30 is located outside of the evaporator housing 26, the heights of other refrigerant distribution system components may be varied to achieve the same result, which is increased space between the refrigerant distribution system and the suction port 42 for vapor refrigerant flow.

In some embodiments, such as shown in FIG. 2, the suction port 42 is located at a first longitudinal end 48 of the evaporator 12. As such, the vapor-liquid separator height 46 is at a minimum at the first longitudinal end 48, or at the suction port 42. In some embodiments, the vapor-liquid separator height 46 is at a maximum at a second longitudinal end 50, opposite the first longitudinal end 48. In the embodiment of FIG. 2 the vapor-liquid separator height 46 is stepped, with a first separator height **46*a* at the first longitudinal end 48, a second separator height 46*b* greater than the first separator height 46*a*, and a third separator height 46*c* greater than the second separator height 46*b* at the second longitudinal end 50. While three separator heights 46*a*-46*c* are shown in the embodiment of FIG. 2**, one skilled in the art will readily appreciate that other quantities of separator heights may be utilized in other embodiments.

Figure 3:
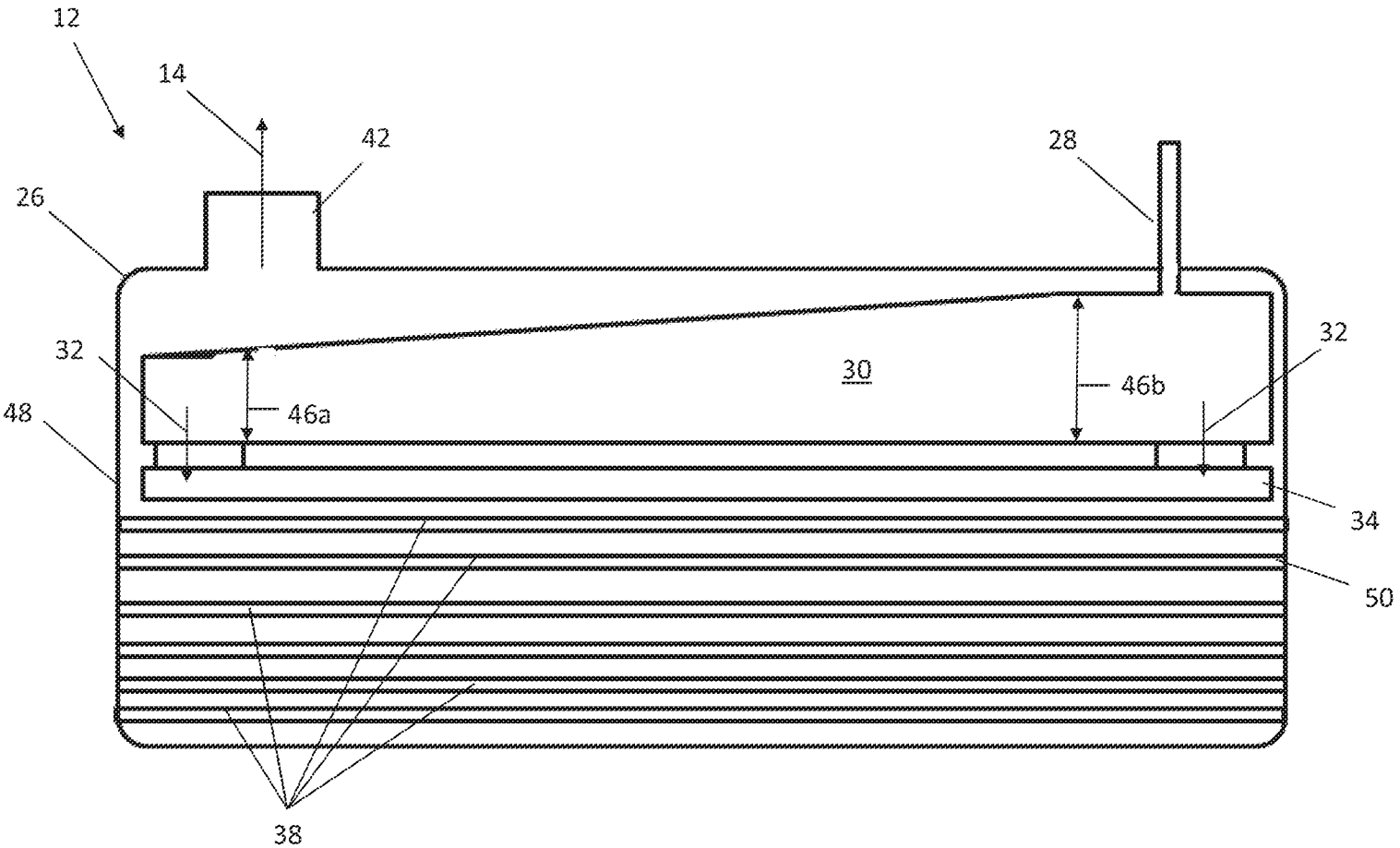
FIG. 3 is a schematic view of an embodiment of a falling film evaporator for an HVAC system.

In another embodiment, such as shown in FIG. 3, the vapor-liquid separator height 46 slopes from a first separator height **46*a* at the first longitudinal end 48 to a second separator height 46*b* at the second longitudinal end 50 greater than the first separator height 46*a*. In the embodiment of FIG. 3, the slope of the vapor-liquid separator height 46 is linear and constant. In other embodiments, however, the slope of the vapor-liquid separator height 46 may vary between the first longitudinal end 48 and the second longitudinal end 50. Further, in some embodiments, the change in vapor-liquid separator height 46** may be non-linear, such as curvilinear.

Figure 4:
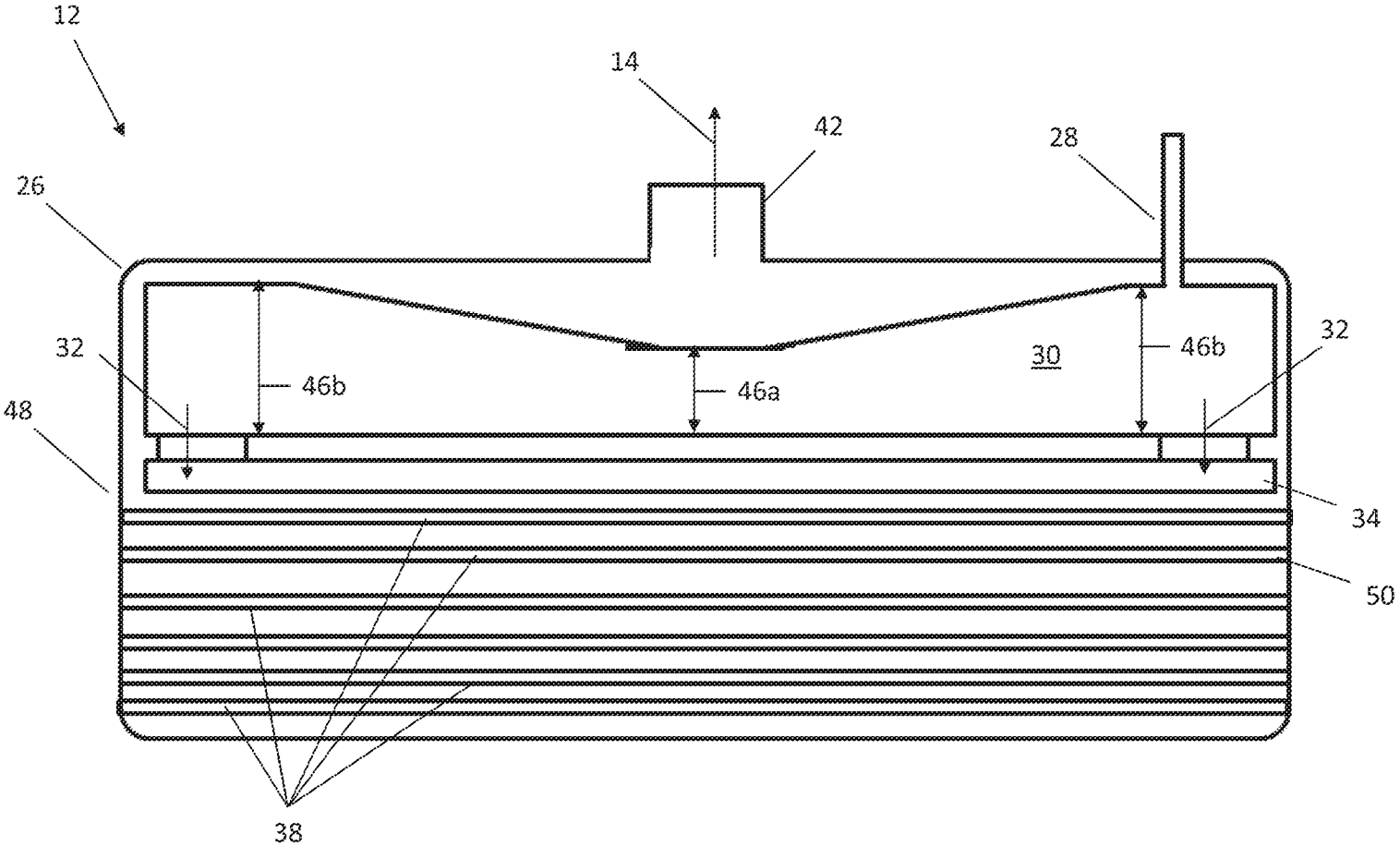
FIG. 4 is a schematic view of an embodiment of a falling film evaporator for an HVAC system.

Referring now to FIG. 4, in some embodiments the suction port 42 is not located at either of the first longitudinal end 48 or the second longitudinal end 50, but between the first longitudinal end 48 and the second longitudinal end 50. For example, in some embodiments the suction port 42 is located midway between the first longitudinal end 48 and the second longitudinal end 50. In such embodiments, the vapor-liquid separator height 46 is at a minimum at the suction port 42 and increases with increasing distance from the suction port 42 toward either or both of the first longitudinal end 48 and the second longitudinal end 50. In some embodiments, the vapor-liquid separator height 46 is at a maximum at either or both of the first longitudinal end 48 and the second longitudinal end 50.

While the present disclosure has been described in detail in connection with only a limited number of embodiments, it should be readily understood that the present disclosure is not limited to such disclosed embodiments. Rather, the present disclosure can be modified to incorporate any number of variations, alterations, substitutions or equivalent arrangements not heretofore described, but which are commensurate in spirit and/or scope. Additionally, while various embodiments have been described, it is to be understood that aspects of the present disclosure may include only some of the described embodiments. Accordingly, the present disclosure is not to be seen as limited by the foregoing description, but is only limited by the scope of the appended claims.

What is claimed is:

1. A falling film evaporator comprising:

an evaporator vessel;

a plurality of evaporator tubes disposed in the evaporator vessel through which a volume of thermal energy transfer medium is flowed;

a suction port extending through the evaporator vessel to remove vapor refrigerant from the evaporator vessel; and a refrigerant distribution system disposed in the evaporator vessel to distribute a flow of liquid refrigerant over the plurality of evaporator tubes, the refrigerant distribution system including a vapor-liquid separator and a distributor located vertically between the vapor-liquid separator and the plurality of evaporator tubes, the refrigerant distribution system configured such that the vapor-liquid separator has a first height at the suction port and a second height greater than the first height at a longitudinal location other than at the suction port.

2. The falling film evaporator of claim 1, wherein the first height is a minimum height of the vapor-liquid separator.

3. The falling film evaporator of claim 1, wherein the first height transitions to the second height with a linear slope.

4. The falling film evaporator of claim 1, wherein the first height transitions to the second height via a vertical step.

5. The falling film evaporator of claim 1, wherein the suction port is located at a first longitudinal end of the evaporator vessel.

6. The falling film evaporator of claim 5, wherein the second height is located at a second longitudinal end of the evaporator vessel opposite the first longitudinal end.

7. The falling film evaporator of claim 1, wherein the suction port is located between a first longitudinal end of the evaporator vessel and a second longitudinal end of the evaporator vessel and the first height is a minimum vapor-liquid separator height.

8. The falling film evaporator of claim 7, wherein the second height is at one or more of the first longitudinal end or the second longitudinal end and is a maximum height of the vapor-liquid separator.

9. A heating, ventilation and air conditioning (HVAC) system comprising:

a condenser flowing a flow of refrigerant therethrough;

a falling film evaporator in flow communication with the condenser including:

an evaporator vessel;

a plurality of evaporator tubes disposed in the evaporator vessel through which a volume of thermal energy transfer medium is flowed;

a distributor disposed in the evaporator vessel above the plurality of evaporator tubes to distribute a flow of liquid refrigerant over the plurality of evaporator tubes;

a suction port extending through the evaporator vessel to remove vapor refrigerant from the evaporator vessel; and a vapor-liquid separator disposed in the evaporator vessel to separate the vapor refrigerant from a vapor and liquid refrigerant mixture, the vapor-liquid separator configured such that the vapor-liquid separator has a first height at the suction port and a second height greater than the first height at a longitudinal location of than at the suction port.

10. The HVAC system of claim 9, wherein the first height is a minimum height of the vapor-liquid separator.

11. The HVAC system of claim 9, wherein the first height transitions to the second height with one of a linear slope or a vertical step.

12. The HVAC system of claim 9, wherein the suction port is located between a first longitudinal end of the evaporator vessel and a second longitudinal end of the evaporator vessel and the first height is a minimum vapor-liquid separator height.

13. The HVAC system of claim 12, wherein the second height is at one or more of the first longitudinal end or the second longitudinal end.

14. The HVAC system of claim 13, wherein the second height is a maximum height of the vapor-liquid separator.

* * * * *